United States Patent [19]

Morrone

[11] Patent Number: 4,832,093

[45] Date of Patent: May 23, 1989

[54] AUTOMATIC CONTAINER FILLING APPARATUS

[76] Inventor: Joseph F. Morrone, 2018 Cuttler Dr., McKees Rocks, Pa. 15136

[21] Appl. No.: 135,834

[22] Filed: Dec. 21, 1987

[51] Int. Cl.[4] ..... B65B 3/36

[52] U.S. Cl. ..... 141/40; 141/46; 141/90; 141/95; 141/198

[58] Field of Search ..... 141/90, 40, 46, 91, 141/95, 96, 198, 39

[56] References Cited

U.S. PATENT DOCUMENTS 3,522,824 8/1970 Allen et al. ..... 141/90

3,527,267 9/1970 Moore ..... 141/90 X

*Primary Examiner*—Harvey C. Hornsby

*Assistant Examiner*—Joseph S. Machuga

*Attorney, Agent, or Firm*—Paul Bogdon

[57] ABSTRACT

An automatic container filling apparatus for continuously filling a moving line of containers with a fluent material is disclosed. The flow of material to any container is controlled by a single supply of air at a predetermined pressure above atmospheric pressure. The apparatus includes a product filling head having an outlet nozzle arranged to extend into the mouth of a container to be filled. An air supply provides regulated air at a predetermined high pressure. There is also provided a control for receiving and directing the high pressure air to the other components of the apparatus. A sensor tube is adapted to be positioned at a fixed point within the container to be filled. Air from the controller is directed through the sensor tube during the filling of the container. An actuator valve and an interface valve both communicate with the control to receive the high pressure air therefrom. The actuator valve in response to the high pressure air opens the product filling head to discharge product into the container. The interface valve also communicates with the sensor tube and in response to back pressure from the tube caused by product in the container reaching the tube's outlet, directs stored high pressure air to the control to close the control to flow of air, whereby the actuator valve will close the product filling head. There is also provided a sensor tube clearing valve for clearing residual product from the sensor tube prior to the filling operation, and a variable air flow restrictor for varying the flow of high pressure air to the sensor tube for selectively varying its sensitivity.

3 Claims, 2 Drawing Sheets

AUTOMATIC CONTAINER FILLING APPARATUS

BACKGROUND OF THE INVENTION

This invention relates to an automatic container filling apparatus of the type that continuously fills moving containers with a liquid or other fluent material, and particularly to such container filling apparatus which uses a single supply of regulated air at a predetermined pressure above atmospheric in controlling the flow of product to a container. More particularly, this invention relates to an automatic container filling apparatus which includes a sensor tube arranged to be positioned in a container to be filled where high pressure air flows out of the tube during filling and when the product reaches the sensor tube the back pressure realized causes the container filling operation to cease.

There are various known automatic container filling machines wherein a sensing tube extends into a container to be filled and when the lower end of the tube is blocked by the product in the container back pressure through the tube actuates a control device to stop the flow of product to the container. The known filling machines generally use two sources of air pressure as elements of the control functions for the filling operation. High pressure air is directed through the control system to open the product fill valve and to blow out the sensor tube of residual product prior to filling. Low pressure air is directed to the sensor tube and to auxiliary control elements such as pneumatic compensator devices. The compensators function to sense the high pressure control air and any back pressure derived from the sensor tube when the product level in the container being filled reaches the sensor tube. The differential pressure between the high pressure control air and the back pressure will result in the fill valve of this system closing the flow of product to the container. The compensators are generally complicated devices often using resilient diaphragms across chambers containing the high pressure control air and back pressure air from the sensor tube. The diaphragms also define a chamber between them containing atmospheric air which enters and exits the chamber through a vent port. The interaction between the diaphragms and the throttling of atmospheric air from the intermediate chamber function to control the product fill valve. The diaphragms will stretch in response to the pressurized air acting on them in order to stabilize into their control orientations. The venting of atmospheric air also has a bearing on the functioning of the diaphragms.

The automatic container filling machines using dual air pressure control and pressure compensating systems have inherent drawbacks. Aside from requiring expensive separate high and low air pressure sources, the complex and sensitive compensators are subject to errors resulting from diaphragms stretching and developing leaks over prolonged periods of use. When either the stretching or leaking occurs false signals are sent from the compensator to the controller and the filling operation may be terminated too late, resulting in overfilling the container. The venting of compensators also causes problems. It is common for venting in a low pressure atmosphere to be irregular, resulting in inconsistent pressure response being communicated to the controller. Such inconsistent pressure responses may cause unequal container filling. Venting of air is also costly since the air used in filling systems is most often treated air or in some instances nitrogen, both of which are expensive items.

The dual air pressure filling systems also require sensitive components for diverting high pressure air from one component to another as well as to the compensators for venting. Shuttle valves are common for diverting the high pressure air. The low pressure air also calls for components within the low pressure air circuitry. The higher the number of components required in the system, the higher the expense of the system as well as the greater the need for maintenance and replacement. Whenever component parts are replaced in the system, time comsuming and necessarily expensive recalibration of the system using expensive special instrumentation is required.

This invention overcomes the inherent drawbacks of the heretofore known automatic filling machines of the type described by providing a machine using a single regulated high pressure air supply for controlling the flow of product to the container to be filled. The use of a single source of control air in my system eliminates the need of a pressure balancing compensator, or the like, as well as the need for venting of control air and control pressure diverting components. My automatic filling machine uses a significantly lower number of component parts as compared to the heretofore known systems, resulting in a system which is relatively inexpensive as compared to the known systems as well as a system which is simple in its operation and has low maintenance requirements. In addition, the components of my system are relatively simple in construction and their replacement is easy and not nearly as expensive as replacement of the complicated compensators and other component parts of the known systems. Also, my system does not require any expensive, time consuming recalibration whenever any of the component parts are replaced. My system is also simply packaged and installation on new or existing filling machines is easily achieved by two connections, namely to the fill sensor tube and product source. Thus, my invention provides an inexpensive, automatic container filling apparatus which uses a single source of regulated air to control the filling operation without changing the air pressure while using a significantly low number of relatively simple and insensitive component parts, eliminating the need for system recalibration whenever component parts are replaced. The single source of regulated air results in simple, direct pressure control as compared with complex differential pressure control of the known systems.

SUMMARY OF THE INVENTION

This invention provides an automatic container filling apparatus which preferably comprises: a product filling head having a product supply inlet and an outlet nozzle to be extended into the open mouth of a container to be filled; air supply means for providing regulated air at a predetermined pressure above atmospheric pressure; control means communicating with the air supply means for receiving air at the regulated predetermined pressure for directing and discontinuing the flow of air; valve means operative with the air supply means for opening the air supply means when the container to be filled is in the filling position and for closing the air supply means when there is no container in the filling position; product level sensor means having a sensor tube terminating in an outlet at a predetermined level within the container to be filled and extending to a point below the end of the outlet nozzle of the product filling head during the filling operation; the product level sensing means communicating with the control means to receive air at the regulated predetermined pressure into and through the sensor tube during the filling of the container; actuator means communicating with the control means and the product filling head responsive to the flow of air at said predetermined pressure for opening the product supply inlet and for closing the product supply inlet when air ceases to be supplied thereto; and an interface operator means communicating with the product level sensing means and the control means for closing the control means to flow of air therefrom in response to a predetermined back pressure from the product level sensor tube caused by product in the container reaching the open end of the sensor tube. My invention may also be provided with sensor tube clearing means communicating with the air supply means for directing the flow of air at the regulated predetermined pressure to the sensor tube prior to the filling of the container for clearing the sensor tube of any material therein. Also, my invention may include variable restrictor means communicating between the control means and the sensor tube for selectively varying the flow of air at the regulated predetermined pressure to the sensing tube. The restrictor means allows selective variation of the degree of sensitivity of the sensor tube.

Various other advantages, details, and modifications of the present invention will become apparent as the following description of a certain present preferred embodiment proceeds.

DESCRIPTION OF THE DRAWINGS

In the accompanying drawings I show a certain present preferred embodiment of my invention in which.

DESCRIPTION OF A PREFERRED EMBODIMENT

Figure 1:
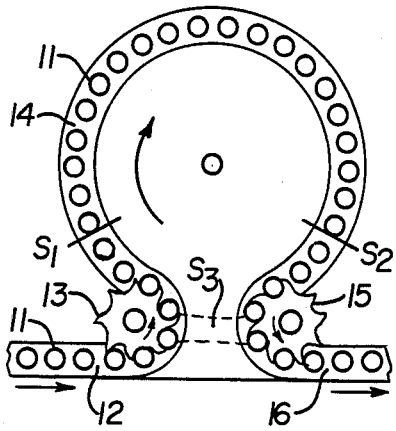
FIG. 1 is a diagrammatic plan view showing a filling machine of the type for which my automatic container filling apparatus is particularly adapted.
Figure 3:
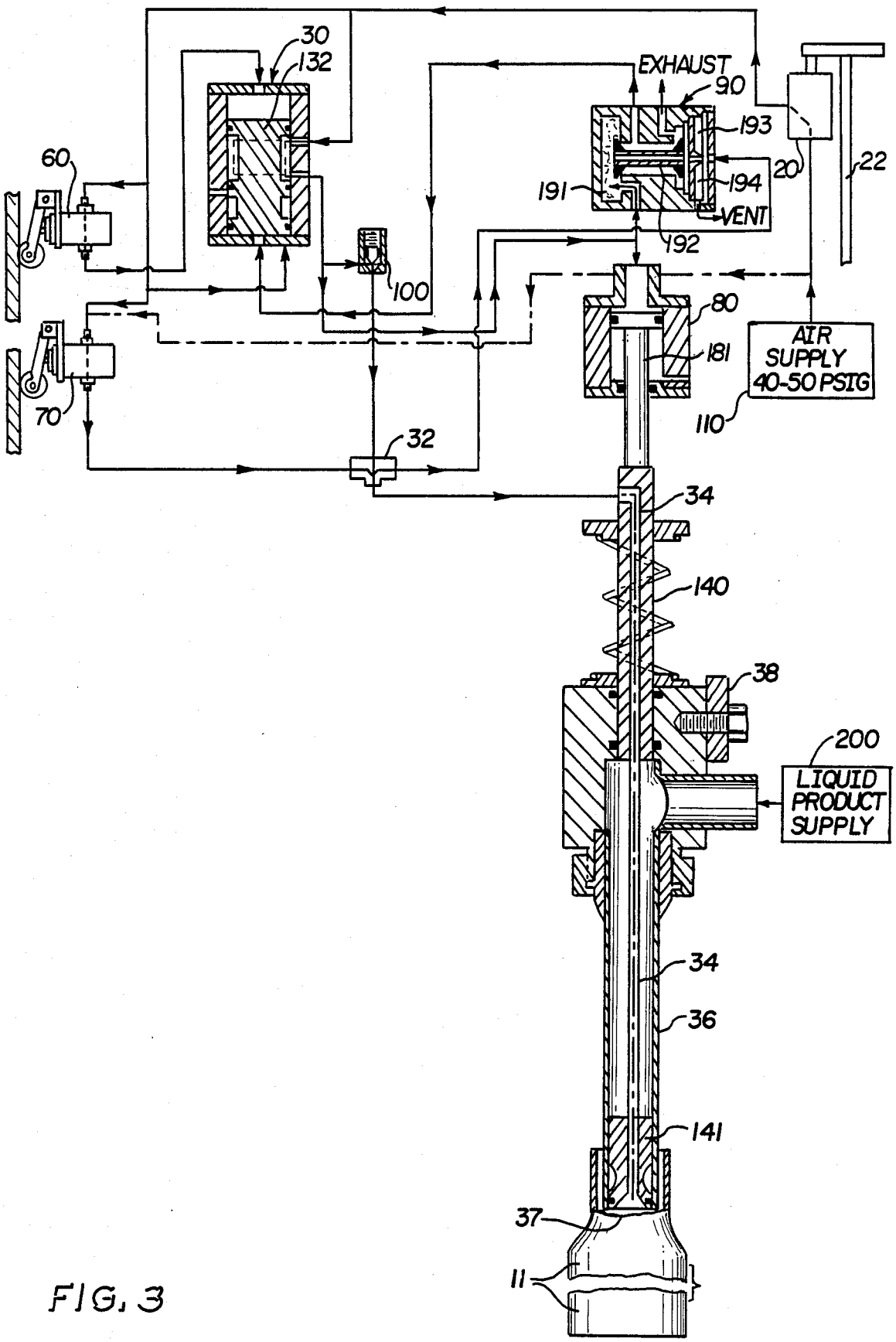

Referring now to the drawings, FIG. 1 diagrammatically shows containers 11 arriving on a belt conveyor 12, the containers 11 transferred by starwheel 13 in spaced relation onto a continuously rotating table 14 of a filling machine assembly. The containers 11, which may be plastic bottles as illustrated in FIG. 3 are filled with a fluent product such as liquid medicine as they are carried around on the rotating table. A second starwheel 15 removes the filled containers from the table 14 and delivers them to a take-away conveyor 16.

Figure 2:
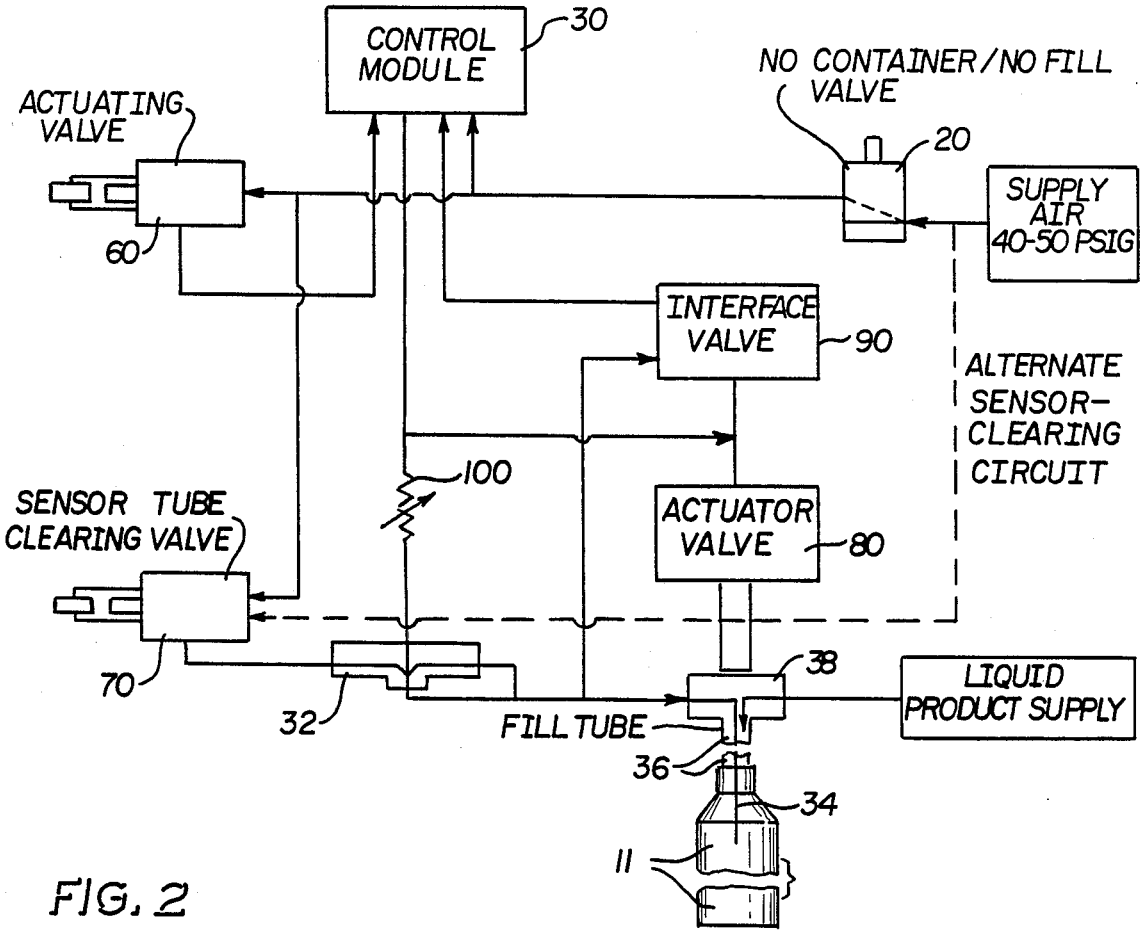
FIG. 2 is a schematic representation of the interacting elements and the single source of control air of the automatic container filling apparatus of my invention and FIG. 3 is a partly sectional, partly diagrammatic view illustrating the automatic container filling apparatus of my invention and showing more details of construction of the various elements as compared with the schematic representation of the invention.

A uniformly spaced series of automatic filling apparatus of my invention rotates with the table 14, one for each container being filled and one of which is schematically shown in FIG. 2 and diagrammatically shown in FIG. 3. My inventions are engaged in filling relation with the containers during travel between stations on the table 14 such as between stations $S_1$ and $S_2$ shown in FIG. 1.

The structural details of filling machines and the sequential operation of automatic filling apparatus and their mounting arrangements and actuation in the filling machine assembly are all well-known to those skilled in the art and need not be described. The particular features of filling machines are not considered as unique and are not directly a part of my present invention, but are rather the environment in which my invention is to be used.

The novel feature of my invention is the use of a single source of regulated air at a predetermined pressure above atmospheric for the control of the container filling process. By using the single source of regulated air my automatic container filling apparatus uses a minimum number of elements. Also, the operation of my apparatus is simple and direct. FIG. 2 schematically illustrates my invention and shows a regulated source of air at between 40 and 50 psig. The regulated air is supplied to a no container-no fill valve 20 which is in a closed position whenever there is no container in the filling station. The valve 20 is controlled by a container guide mechanism which is found on existing filling machines. The guide mechanism is responsive to the presence and absence of a container in the fill station to open and close the valve 20 to allow and stop passage of the regulated air to the rest of the container filling apparatus of my invention. The regulated air will pass to a control module 30, a cam actuated fill actuating valve 60, and a cam actuated sensor tube clearing valve 70. Regulated air may also be supplied directly to the sensor tube clearing valve 70 as illustrated by the broken line between the air source and the valve 70. Both the actuating fill valve 60 and sensor tube clearing valves 70 are actuated by cams which engage projections on stationary tracks forming part of the filling machine assembly. The sensor tube clearing valve 70 is actuated first in the sequence of actuation of the valves 60 and 70, and air is sent through a sensor tee 32 into a sensor tube 34 which is disposed to enter into a container 11 to be filled to terminate in an open end at a level within the container at a point below the level of the outlet of the container filling nozzle 36 which is part of the filling head 38. The air passing through the sensor tube clearing valve 70 and into the sensing tube 34 serves to clear any residual product remaining in the sensor tube from a preceding container filling operation. The sensor tube valve 70 then closes and the fill actuating valve 60 is actuated by the cam acting on the stationary track and air will pass from the valve 70 to a pilot input in the control module 30 instantly opening the control module to direct air to an air cylinder 80 and an interface valve 90. Also, air is directed from the control module through a variable restrictor 100 to the sensor the 32 and into the sensor tube 34. The air cylinder 80 serves to control the opening and closing of the product filling head 38 and when air fills the air cylinder 80 the filling head 38 will be opened to allow product to flow into the container 11 to be filled. While the container 11 is being filled air from the control module 30 will be flowing into and out of the open ended sensor tube 34. The variable restrictor 100 is selectively adjustable to vary .the sensitivity of the sensing tube 34. When the desired product level is reached in the container 11 the open end of the sensor tube 34 will be closed off by the product and a back pressure will be realized and communicated to the interface valve 90. The back pressure serves as an input signal to a pilot connection in the interface valve 90 causing the interface valve 90 to open and discharge a supply of stored air to the control module 30. The discharged stored air from the interface valve 90 serves as a pilot signal to the control module 30 closing the control module to the flow of air to the air cylinder 80 resulting in the filling head 38 closing and thereby ceasing the flow of product to the container 11. The filled container leaves the filling station and as a result the guide mechanism shifts to close the no container-no fill valve 20. An empty container will then be transported to the fill station and another fill cycle will begin.

FIG. 3 illustrates with additional detail the interacting element of my automatic container filling apparatus. A schematically illustrated air supply 10 provides regulated air at a high pressure, typically between 40 and 50 psig. The regulated air is supplied to a schematically represented no-container-no-fill valve 20, of well-known construction, which is in a closed position whenever there is no container in the filling station. Valve 20 is controlled by a container guide mechanism 22 of well known construction and arrangement on filling machines. The guide mechanism 22 is responsive to the presence and absence of a container in the fill station to open and close the valve 20 to allow and stop passage of the regulated air to the rest of the elements of the container filling apparatus of this invention. With a container 11 in position in the fill station, the guide mechanism 22 will move to open valve 20 and regulated air will pass to control module 30, cam actuated fill actuating valve 60, and cam . actuated sensor tube clearing valve 70. Regulated air from air supply 110 may also be supplied directly to sensor tube clearing valve 70 as illustrated by the broken line between air supply 110 and the valve 70. Both the actuating fill valve 60 and sensor tube clearing valve 70 are actuated by cams which engage projections on stationary tracks forming part of the filling machine assembly. The sensor tube clearing valve 70 is actuated first in the sequence of actuation of the valves 60 and 70, and regulated air is sent through a sensor tee 32 into a sensor tube 34 which is disposed to enter into container 11 to be filled to terminate in an open end at a predetermined level within the container at a point below the level of the outlet 37 of the container filling nozzle 36 which forms part of the filling head 38. The regulated air passing through the sensor tube clearing valve 70 and into the sensing tube 34 serves to clear any residual product remaining in the sensor tube from a preceding container filling operation. The sensor tube valve 70 then closes and the fill actuating valve 60 is actuated by the cam acting on the stationary track and regulated air will pass from the valve 60 to the control module 30 to drive an internal spool 132 to an on position, as shown, allowing the regulated air to discharge from the control module 30 through a variable restrictor 100 to a sensor tee 32 and into sensor tube 34. Regulated air is also simultaneously discharged from the control module 30 to an air cylinder 80 and an interface valve 90. The air cylinder is operably connected with the product filling head 38 and serves to control the opening and closing of the filling head. When air fills the air cylinder 80 the piston 181 will be moved against the spring biased plunger 140 forming part of the filling head 38 to move the sensor tube 34 and integrally connected plug 141 outwardly of the outlet 37 the filling nozzle 36 to thereby position the sensor tube 34 at its predetermined fill level in container 11 and to open the outlet 37 to flow of product from the liquid product supply 200 through the body of the filling head 38 through filling nozzle 36 and out the outlet 37 and into container 11. While the container 11 is being filled regulated air from the control module 30 will be flowing into and out of the open end of the sensor tube 34. Air from the control module 30 flowing to the interface valve 90 will be stored in the bottom chamber 191 with a minute bleed of air through a seal poppet valve 192. The air flowing through poppet valve 192 will enter chamber 193 and will pass through a vent port. Chamber 193 and the vent port are disposed beneath a control diaphragm 194.

When fluid flowing from the liquid product supply 200 through the filling nozzle 36 into container 11 reaches the open end of the sensor tube 34, thus blocking the flow of air from the sensor tube 34, a back pressure results through the air supply line supplying air to the interface valve 90. The back pressure becomes the pilot signal for the interface valve 90. The pilot signal results in diaphragm 194 depressing to seal the bleed channel of the poppet valve 192 to prevent bleed air from flowing from chamber 191. A build up of pressure results on the poppet valve 192 which is driven by the pressure off of its seat in chamber 191. Air then flows around the poppet valve 192 and out of the interface valve 90 to the control module 30. The regulated air from the interface valve 90 actuates the spool 132 in the control module 30 to an off position to shut the flow of supply air through the control module to the other elements of the filling apparatus. With regulated supply air shut off, the urging of the spring acting on the plunger 140 of the filling head 38 will move the plunger 140 upwardly against the piston 181 of the air cylinder 80. The upward or closing movement of the plunger 140 will move the sensing tube 34 and plug 141 to close the outlet 37 of the filling nozzle 36 to stop the flow of fluid into the container 11. The filled container 11 will be moved out of the fill station and the guide mechanism 22 will move to close the valve 20 to thereby shut off flow of regulated supply air to the container apparatus of this invention. An empty container moved into the fill station will actuate the guide mechanism 22 to begin a new filling cycle in the manner described hereinabove.

It should now be readily apparent to those skilled in the container filling control art how my present invention achieves the advantages over heretofore known filling apparatus. It should also be understood by those skilled in this art that my present invention may be modified without changing its essence, that is the use of a single source of regulated air for achieving the container filling control functions.

While I have shown and described a present preferred embodiment of this invention, it is to be distinctly understood that the invention is not limited thereto, but may be otherwise embodied within the scope of the following claims.

I claim:

1. Automatic container filling apparatus comprising:

a product filling head having a product supply inlet and an outlet nozzle to be extended into the open mouth of container to be filled;

air supply means comprising a single source for providing regulated air at a predetermined single operating pressure above atmospheric pressure;

control means communicating with said air supply means for receiving air at said predetermined single operating pressure and for directing and discontinuing the flow of said air;

valve means operative with said air supply means for opening said air supply means when the container to be filled is in the filling position and for closing said air supply means when there is no container in the filling position:

product level sensor means having a sensor tube terminating in an open end at a predetermined level within the container to be filled and extending to a point below the end of said outlet nozzle during the filling operation;

said product level sensor means communicating with said control means to receive air at said predetermined single operating pressure into and through said sensor tube during the filling of the container:

actuator means communicating with said control means and said product filling head responsive to the flow of air at said predetermined single operating pressure for opening said product supply inlet and for closing said product supply inlet when air ceases to be supplied thereto;

an interface operator means communicating with said product level sensing means an said control means for closing said control means to flow of air therefrom in response to a predetermined back pressure from said product level sensor tube caused by product in the container reaching said open end of said sensor tube; and tube clearing means communicating with said air supply means for directing the flow of air at said predetermined single operating pressure to said sensor tube prior to the filling of the container for clearing said sensor tube of any material therein and for shutting the flow of tube clearing air to said sensing tube during the filling of the container.

2. Automatic container filling apparatus as set forth in claim 1 wherein said control means includes fill actuating valve means communicating with said air supply means for opening the flow of air from said control means in response to the positioning of the container in the filling position.

3. Automatic container filling apparatus as set forth in claim 1 including variable restrictor means communicating with said control means for selectively varying the flow of air at said predetermined pressure to said sensing tube.

* * * * *